US008441248B2

(12) United States Patent
Kachorek et al.

(10) Patent No.: US 8,441,248 B2
(45) Date of Patent: May 14, 2013

(54) LAUNDRY TREATING APPLIANCE WITH VOLTAGE DETECTION

(75) Inventors: Jason P. Kachorek, Saint Joseph, MI (US); David J. Kmet, Paw Paw, MI (US); Jason W. Parker, Benton Harbor, MI (US); David M. Williams, Saint Joseph, MI (US); Christopher J. Woerdehoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 405 days.

(21) Appl. No.: 12/909,085

(22) Filed: Oct. 21, 2010

(65) Prior Publication Data

US 2012/0098521 A1 Apr. 26, 2012

(51) Int. Cl.
*G01R 13/02* (2006.01)
*D06F 58/04* (2006.01)

(52) U.S. Cl.
USPC ..... 324/76.83; 34/132

(58) Field of Classification Search ..... None
See application file for complete search history.

(56) References Cited

U.S. PATENT DOCUMENTS

| | | | | |
|---|---|---|---|---|
| 3,953,767 | A | 4/1976 | Ahmed | |
| 4,520,321 | A | 5/1985 | Nakatsugawa et al. | |
| 4,649,654 | A | 3/1987 | Hikino et al. | |
| 4,999,730 | A | 3/1991 | Pickard | |
| 5,006,778 | A * | 4/1991 | Bashark | 318/799 |
| 5,051,996 | A | 9/1991 | Bergeson et al. | |
| 5,075,613 | A * | 12/1991 | Fisher | 318/809 |
| 5,079,410 | A | 1/1992 | Payne et al. | |
| 5,200,684 | A * | 4/1993 | Fisher | 318/809 |
| 5,281,956 | A | 1/1994 | Bashark | |
| 5,319,514 | A | 6/1994 | Walsh et al. | |
| 5,555,641 | A * | 9/1996 | Lee | 34/261 |
| 5,564,831 | A * | 10/1996 | Bashark | 34/493 |
| 5,578,928 | A * | 11/1996 | Langan | 324/509 |
| 5,623,201 | A | 4/1997 | Park | |
| 5,640,113 | A | 6/1997 | Hu | |
| 5,923,676 | A | 7/1999 | Sunter et al. | |
| 6,150,792 | A | 11/2000 | Andersson | |
| 6,198,403 | B1 | 3/2001 | Dorrough et al. | |

(Continued)

FOREIGN PATENT DOCUMENTS

| | | | |
|---|---|---|---|
| CN | 101694935 | A | 4/2010 |
| DE | 19733533 | A1 | 2/1999 |
| EP | 0436374 | A2 | 7/1991 |
| EP | 1087053 | B1 | 3/2001 |
| GB | 1596993 | | 9/1981 |
| JP | 58050474 | A | 3/1983 |
| JP | 8126795 | A | 5/1996 |
| JP | 10108992 | A | 4/1998 |
| JP | 2009017674 | A | 1/2009 |
| KR | 20000041255 | A | 7/2000 |
| WO | 2007/004198 | A1 | 1/2007 |

OTHER PUBLICATIONS

German Search Report for DE102011052798, Mar. 15, 2012.

*Primary Examiner* — Jermele M Hollington
(74) *Attorney, Agent, or Firm* — Clifton G. Green; McGarry Bair PC

(57) ABSTRACT

A method of determining a voltage and phase across an electric heating element in a laundry treating appliance, such as a clothes dryer.

23 Claims, 6 Drawing Sheets

U.S. PATENT DOCUMENTS

| | | | |
|---|---|---|---|
| 6,201,369 | B1 | 3/2001 | Johnson |
| 6,271,506 | B1 | 8/2001 | Glaser |
| 6,304,189 | B1 | 10/2001 | Koch et al. |
| 6,397,157 | B1 | 5/2002 | Hogle et al. |
| 6,404,348 | B1 | 6/2002 | Wilfong |
| 6,457,145 | B1 | 9/2002 | Holmberg et al. |
| 6,597,144 | B2 | 7/2003 | Pearson et al. |
| 6,763,485 | B2 | 7/2004 | Whetsel |
| 6,841,761 | B1 | 1/2005 | Banzato et al. |
| 6,995,965 | B2 | 2/2006 | Hameed et al. |
| 7,282,921 | B2 | 10/2007 | Sela et al. |
| 2002/0009312 | A1 | 1/2002 | Sugimoto et al. |
| 2009/0206816 | A1 | 8/2009 | Henle et al. |
| 2009/0206818 | A1 | 8/2009 | Horan |
| 2010/0013491 | A1 | 1/2010 | Hooper et al. |
| 2012/0096736 | A1 * | 4/2012 | Bellinger et al. ..... 34/427 |

* cited by examiner

LAUNDRY TREATING APPLIANCE WITH VOLTAGE DETECTION

BACKGROUND OF THE INVENTION

Laundry treating appliances, such as clothes dryers may have several components that draw a high level of power from the power source to the appliance. These components may include the electric heating element and the airflow system of the clothes dryer. Sometimes, the power supply to homes and laundromats may be wired incorrectly so that the electrical power delivered to the clothes dryer may not be what is expected. Additionally, it may not be known if the home or the laundromat has 2-phase or 3-phase power available. If the power source type is not known or if the home or laundromat is wired incorrectly, the components of the clothes dryer may not perform as expected. A lower than expected power delivery to the electric heating element may result in the generation of less than optimal heat by the electric heating element, potentially leading to longer than expecting drying times.

SUMMARY OF THE INVENTION

The invention relates to a method of determining a voltage across an electric heating element in a clothes dryer supplied by AC mains (L1, L2, and N). L1 to N voltage and L2 to N voltage applied to the electric heating element are determined sequentially. A zero-crossing timing signal from the zero crossings of the L1 to N signal with the same frequency as the AC line frequency is generated and received by a controller. A peak time corresponds to a peak in the amplitude of the L2 signal applied to the electric heating element is determined and a time differential between the peak time and a zero-crossing from the zero-crossing signal is determined. A phase relationship between L1 and L2 is determined by matching the time differential to at least one time window indicative of an anticipated phase relationship and L1 to L2 voltage is determined based on the L1 to N voltage, L2 to N voltage, and the phase relationship.

DESCRIPTION OF AN EMBODIMENT OF THE INVENTION

The present invention relates generally to determining the phase compensated L1 to L2 line voltage across an electrical heating element in a clothes dryer. More specifically, the L1 to L2 phase compensated line voltage is determined without any adding any additional hardware to a clothes dryer and without the ability to measure both the L1 to N line voltage and the L2 to N line voltage at the same time.

The power input via L1, L2 and N may be 2-phase power from local power utility companies and distributed throughout the house using standard household electrical wiring. The clothes dryer may be plugged into a wall socket (not shown) delivering sinusoidal alternating current (AC) with L1, L2 and N connections. The L1 and L2 lines may both be 120 V with frequency of 60 Hz, and a phase offset from each other by 180 degrees ($\pi$ radians) for an L1 to L2 root mean square (RMS) voltage of 240 V. This may be the predominant power source in North America and parts of South America. Alternatively, the L1 and L2 lines may be 230 V sinusoidal with frequency of 50 Hz, and a phase offset from each other by 180° degrees ($\pi$ radians) for an L1 to L2 RMS voltage of 460 V. This may be the predominant power source in Europe, most of Asia, Australia, Africa, and parts of South America. As a further alternative, the clothes dryer may receive three-phase power including L1, L2, L3, and N lines, where each phase is offset from the other by 120° ($2\pi/3$ radians).

Figure 1:
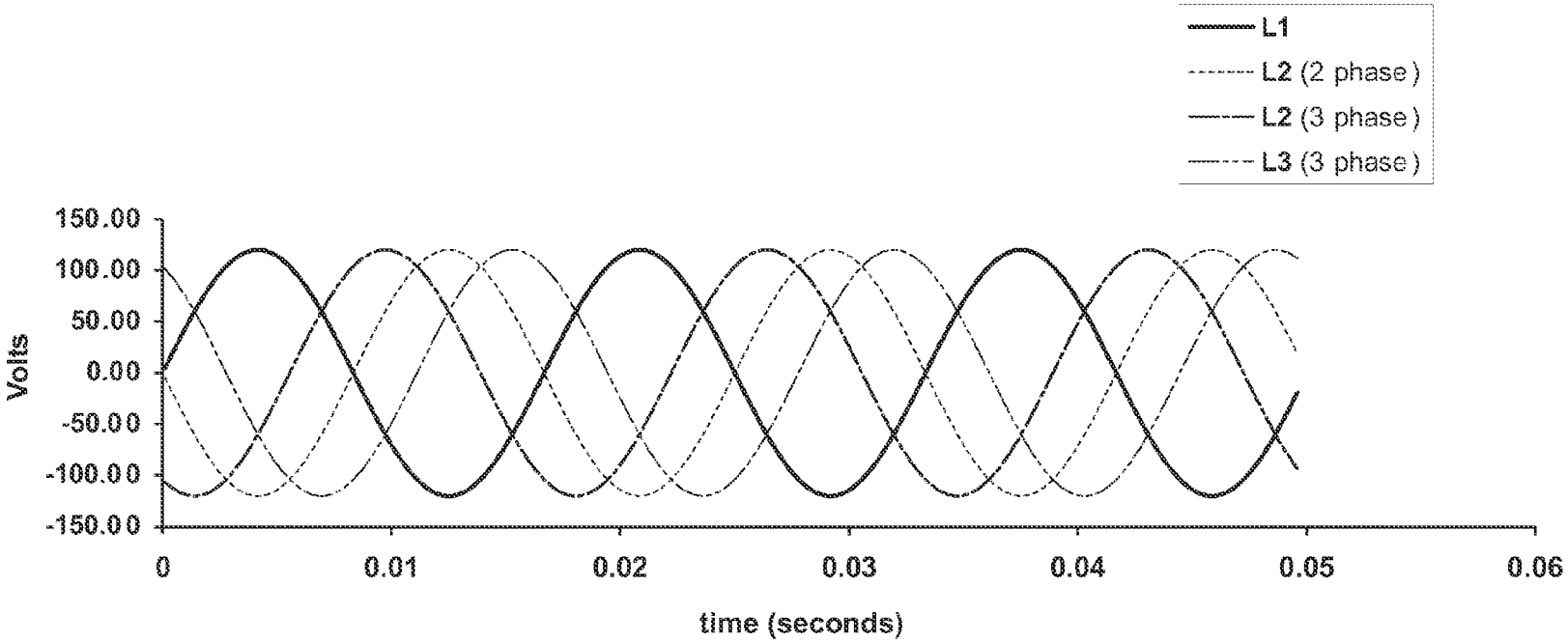
FIG. 1 is a graph illustrating various time-varying line voltages for two-phase and three-phase power.
Figure 2:
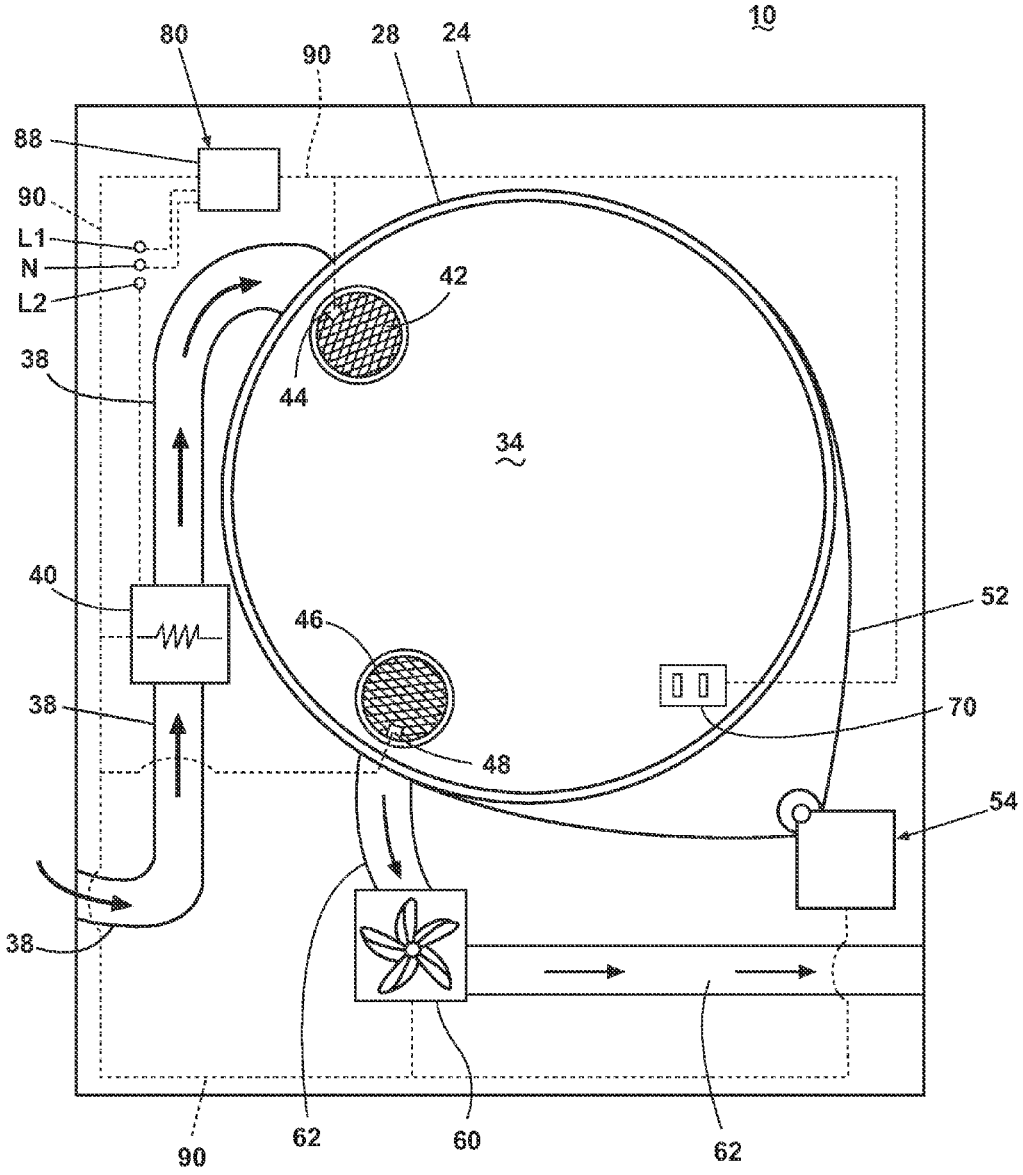
FIG. 2 is a schematic sectional view through the clothes dryer of showing a system controller and two-phase power input.

FIG. 2 is a graph plotting multiple phases of either a two-phase power input or a three-phase power input. The phase offset between L1 and L2 in a two-phase system is 180° ($\pi$ radians). However, the phase offset between L1 and L2 in a three-phase power input is 120° ($2\pi/3$ radians). The phase offset between L1 and L3 in a three-phase power input is 240° ($4\pi/3$ radians). Sometimes, the power delivery network within a home may be wired incorrectly. For example, L2 or L3 from a three-phase source may be wired to the L2 of a two-phase wall socket. In such a case, the L1 to L2 phase difference may be either 120° ($2\pi/3$ radians) or 240° ($4\pi/3$ radians), instead of 180° ($\pi$ radians) as it is supposed to be from a two-phase supply. Therefore, instead of RMS voltage of 240 V, the power supply may only deliver RMS voltage of 208 V. When this power source is applied to the components of a clothes dryer, there may be a significant shortfall in the amount of power available to each of the individual components. For example, the electric heating element of the clothes dryer may have a 25% decrease in available power from the power source. This may reduce the overall thermal output of the electric heating element and increase the drying time of the laundry in the clothes dryer. The airflow through the drying chamber may also be curtailed due to the reduced available power to the blower of the clothes dryer, which may also lead to longer drying times. Additionally, it is possible that even if the lines are wired correctly, the voltage delivered to the home may not be at specification, which can result in a significant shortfall in the power available to the various components of the clothes dryer. For example, if the voltage to the home is 20% lower than what is expected (198 V instead of 240 V), then this may result in a 35% shortfall in the power delivered to the components, such as the electric heating element, of the clothes dryer.

Longer drying cycle times resulting from low power availability to the clothes dryer can result in customer dissatisfaction. For example, the consumer may have some expectations of drying times for a particular load based on sales information, advertisements, clothes dryer specifications, or sales demonstrations. If the clothes dryer consistently underperforms compared to the consumer's expectations, it may lead to customer frustration, potential return of the product, or poor consumer reviews. Additionally, the controller of the clothes dryer may predict an end of cycle time based on an assumption that the dryer is receiving the power that is expected form the power supply and the L1 and L2 power connections. If the clothes dryer is receiving less than the expected power from the L1 and L2 power connections, then the controller may consistently under predict the end of cycle times, again with the potential of customer frustration. As a result, it may be beneficial for the clothes dryer to determine the actual L1 to L2 phase and L1 to L2 phase compensated voltage. Such L1 to L2 voltage may be reported to the consumer or service personal by the clothes dryer to indicate if there is a potential issue with power supply to the clothes dryer. L1 to L2 voltage information would indicate if slow dry times are due to problems with the clothes dryer or with the supply of power to the clothes dryer. It may also be beneficial to use L1 to L2 voltage information to make more accurate predictions of drying times and time to the end of cycle. A method of determining the L1 to L2 phase compensated voltage without the addition of any hardware to the clothes dryer is disclosed.

FIG. 2 is a schematic sectional view of a clothes dryer 10 with a housing 24 defining an interior in which is rotatably mounted a drum 28, which defines a drying chamber 34 and illustrating the air flow, sensors, and controls. The air flow system includes an air inlet 42 to the drying chamber 34, which is supplied air via an air inlet conduit 38, and an air outlet 46 to the drying chamber 34, which is exhausted air via an air outlet conduit 62. An electric heating element 40 may be provided in the inlet conduit 38 to heat the air passing through the air flow system. A blower 60 may be provided in the air outlet conduit 62 to force air thorough the air flow system. The air entering the drying chamber 34 may be selectively heated by energizing/de-energizing the electric heating element 40. A motor 54 may be provided for rotating the drum 28 via drive belt 52. The motor 54 may be of the permanent magnet brushless DC or the AC induction type and may contain a motor start winding and a main winding, where one or the other of the start and main windings may be selectively or mutually energized.

An air inlet temperature sensor 44 may be located in fluid communication with the air flow system to detect the air inlet temperature. The air inlet temperature sensor 44 may be located at the air inlet 42 or anywhere else in the inlet conduit 38. An air outlet temperature sensor 48 may also be in fluid communication with the air flow system to detect the air outlet temperature. The air outlet temperature sensor 48 may be located at the air outlet 46 or anywhere else in the outlet conduit 62. The inlet temperature sensor 42 and the outlet temperature sensor 48 may be thermistors or any other known temperature sensing device. A moisture sensor 70 for detecting the presence of moisture in the laundry may be located within the drying chamber 34.

A controller 80 may be communicatively coupled to the various electronic components of the clothes dryer 10 including the electric heating element 40, the inlet temperature sensor 44, the outlet temperature sensor 48, the humidity sensor 70, the motor 54, and the blower 60 via electrical communication lines 90. The controller 80 may be a control board with a microprocessor, microcontroller, field programmable gate array (FPGA), application specific integrated circuit (ASIC), or any other known circuit for control of electronic components.

The clothes dryer 10 also includes power inputs including L1 line power (L1), L2 line power (L2), and neutral line (N). The power delivered through a combination of L1, L2, and N power all of the electrical components of the clothes dryer 10 and the delivery of the power to each component of the clothes dryer 10, such as the electric heating element 40 and the blower 60 is controlled by the controller 80.

Figure 3:
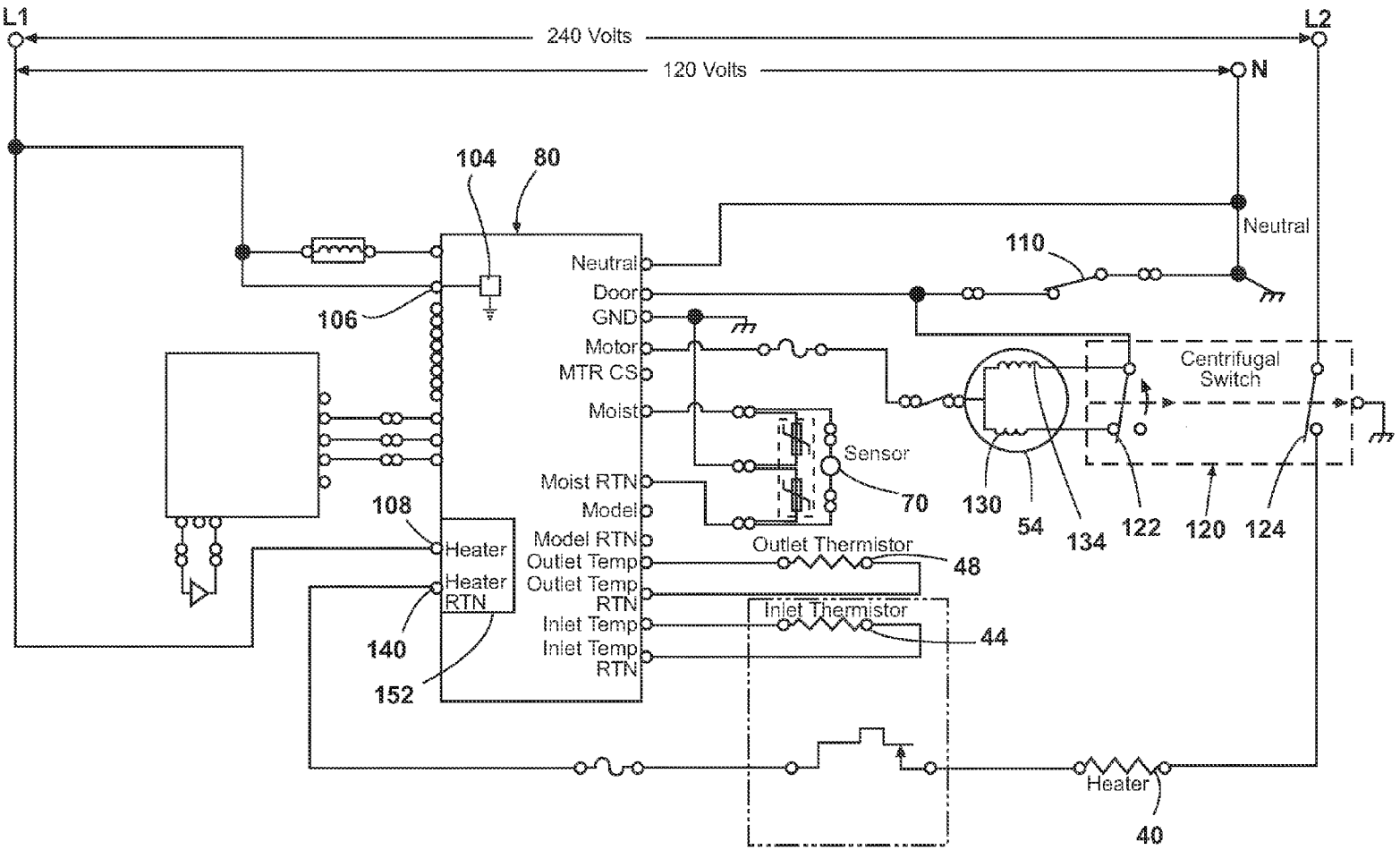
FIG. 3 is an electrical wiring diagram of the clothes dryer showing various components of the clothes dryer connected to the controller and with a two-phase power input.

FIG. 3 shows an electrical wiring diagram of the clothes dryer 10 with controller 80 connected to the various components and sensors of the clothes dryer 10 and showing the wiring of the L1, L2 and N lines. L1 may be wired to L1 input node 106 and the heater relay node 108 of the controller 80. The L1 input node 106 has a zero-cross circuit 104 that generates a periodic signal based on the input at L1 input node 106. L2 may be wired to a heater switch 124 within centrifugal switch 120. The centrifugal switch also contains a motor winding switch 122 that switches between energizing a motor start winding 130 and motor main winding 134 or just the motor main winding 134 of the motor 54. The winding 130 and 134 of the motor 54 may be energized only if a door switch 110 is closed when the door (not shown) of the clothes dryer 10 is closed. Heater relay return node 140 has voltage detection circuitry (150 shown in FIGS. 4 and 5) within controller 80 for measuring voltage applied to the heater relay return node 140 relative to N. The controller 80 also contains a heater relay 152 that can selectively electrically connect the heater relay node 108 to the heater relay return node 140.

From the electrical wiring diagram, it is seen that L1 voltage and L2 voltage can not be determined simultaneously with the voltage detection circuitry 150 at the heater relay return node 140. The circuit is configured so as to prevent an overload situation, which may arise when the motor 54 is stated at the same time as the heater. The power required to start the motor 54 is substantially higher than that required to run the motor after start. As a result, the voltages of L1 and L2 have to be sensed in sequence as each voltage is applied to the voltage detection circuitry 150. For example, during the start-up of the dryer cycle of operation, an opportunity may exist to measure the L2 and then the L1 voltage at the heater relay return node 140 as the L2 voltage and then the L1 voltage are sequentially present at the heater while the motor 54 is starting up, thus preventing excessive power draw by the clothes dryer 10. In addition, timing information for at least one of L1 and L2 must be available simultaneously with the peak timing information of the other of L1 and L2 to determine the phase difference between L1 and L2. A method to determine L1 and L2 in sequence and then to determine L1 and L2 timing information simultaneously thus extracting L1 to L2 phase information and L1 to L2 voltage using the controller 80 is disclosed herein.

Upon start-up of operation of the clothes dryer 10, it is important to note that due to the potential of excessive power draw, when the motor 54 is starting, the electric heating element 40 may not be simultaneously energized. Therefore, upon start-up, the motor start winding 130 and the motor main winding 134 may be energized by the controller 80 and during this time the electric heating element 40 may not be energized. As a result, the heater switch 124 of the centrifugal switch 120 is open when the motor start winding 130 and motor run winding 132 is energized. When the motor 54 achieves a critical speed the motor start winding 130 is de-energized by appropriately actuating the motor winding switch 122 so that the motor main winding 134 continues and at the same time the heater switch 124 closes. At this point, L2 is electrically connected to heater relay return node 140 as illustrated in the simplified electrical representation of FIG. 4. Because the heater switch 124 is closed and the heater relay 152 is open, L2 voltage appears at voltage detection circuit 150 and the voltage detection circuit 150 may determine the L2 voltage referenced to N during this heater switch 124 and relay 152 configuration. Next, the heater relay 152 closes and the heater switch of the centrifugal switch is also closed as depicted in the simplified electrical representation of FIG. 5. In this configuration, L1 voltage referenced to N can be determined by voltage detection circuit 150. This is because the electric heating element 40 is resistive, and therefore, the voltage at heater relay return node 140 will be essentially the L1 voltage. The voltage detection circuit 150 may be a voltmeter, peak detector, RMS circuit, or any other known circuits to measure various voltage parameters.

Figure 6:
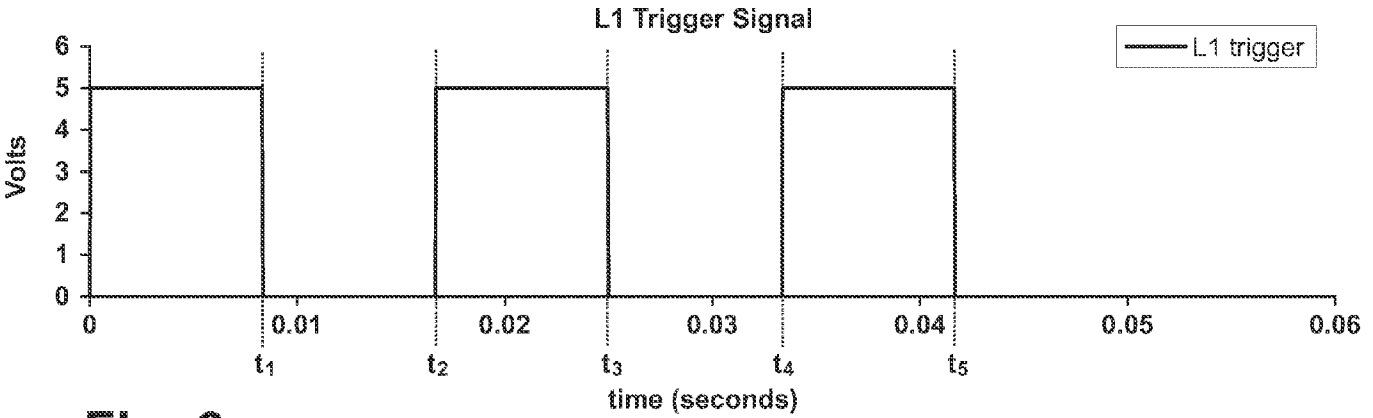
FIG. 6 is a graph of a L1 triggered zero-crossing timing signal generated at one node of the controller shown in FIG. 3.

Although the L1 to N voltage and the L2 to N voltage is determined, the phase relationship between L1 and L2 is not known. To determine the phase relationship, the L1 connection to the L1 input node 106 of the controller 80 applied to the zero-cross circuit 104 generates a periodic L1 zero-crossing timing signal as depicted in the graph of FIG. 6. In particular, the L1 zero-crossing timing signal is high when L1 voltage is positive and is low when L1 voltage is negative. Therefore, the L1 zero-crossing timing signal may have a fixed period $t_2$ equal to the period of L1 and a fixed duty cycle ($t_1/t_2$). The fixed period $t_2$ for a 60 Hz L1 line power may be 16.67 ms and the fixed duty cycle ($t_1/t_2$) may be 0.5 as shown in FIG. 6. Alternatively, the fixed period t2 for a 50 Hz L1 line power may be 20 ms and the fixed duty cycle ($t_1/t_2$) may be 0.5. Three full periods of the L1 zero-crossing timing signal is shown and each period contains a rising edge at times 0, $t_2$, and $t_4$ and a falling edge, at times $t_1$, $t_3$, and $t_5$. The zero-crossing timing signal generated by the zero crossings of the L1 signal received by the controller provides a timing reference for determining a phase relationship of another signal relative to L1. In addition, the zero-crossing signal frequency can be measured by the zero-cross circuit 104, to determine the AC line frequency.

Figure 7:
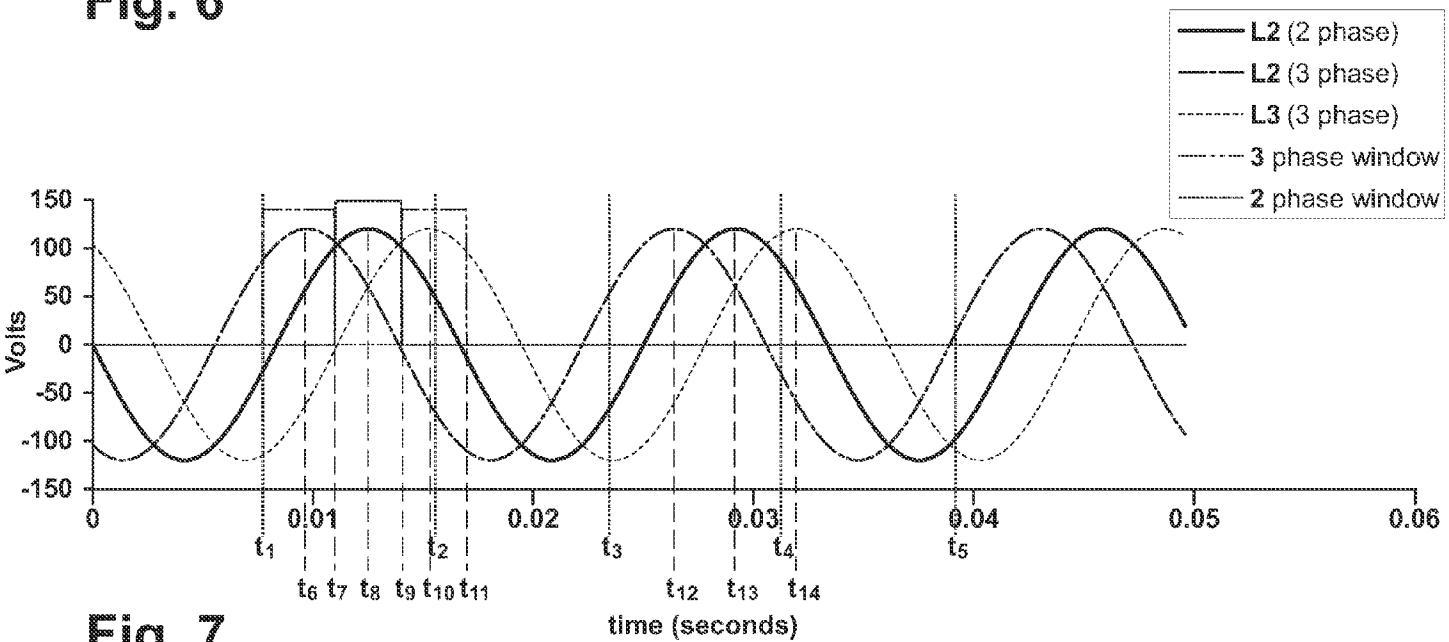
FIG. 7 is a graph corresponding to the L1 zero-crossing trigger of FIG. 6 with various time varying line voltages for two-phase and three-phase power with time windows for detecting the various line voltages according to one embodiment of the invention.

FIG. 7 is a graph that demonstrates the method of determining the phase relationship of the AC mains (L1 to L2 phase) using the L1 timing signal of FIG. 6. L2 (two-phase), L2 (three-phase), and L3 (three-phase) have been plotted on this graph along with three time windows corresponding to phase relationships of 120° (2π/3 radians), 180° (π radians), and 240° (4π/3 radians) relative to L1. In one embodiment the three time windows do not overlap. The voltage detection circuit 150 monitors the line voltage coming into the heater relay return node 140 and detects a peak value in the line voltage at heater relay return node 140. Upon detecting a peak in the L2 voltage amplitude, the controller 80 determines the peak time that corresponds to the peak in the amplitude of the L2 signal applied to the electric heating element 40. When the peak time is determined, the controller 80 determines a time differential between the peak time and a zero-crossing from the zero-crossing timing signal and determines the phase relationship by matching the time differential to at least one time window indicative of an anticipated phase relationship. Each anticipate phase relationship, therefore has a time window relative to a zero-crossing of the zero-crossing timing signal. Determining which time window the peak time falls within may provide what the phase difference is of the voltage on the heater relay return node 140, connected to L2. For example, if the peak voltage falls within the 120° (2π/3 radians) window then the L1 to L2 phase difference is 120° (2π/3 radians). In other words, to determine the L1 to L2 phase relationship, time windows are defined relative to specific points on the L1 trigger signal and then the L2 voltage is monitored to determine in which time window the L2 voltage peaks. By doing so, the controller is cognizant of the phase relationship between L1 and L2.

In this example, the three time windows are referenced to the falling edge of the L1 trigger signal $t_1$ of FIG. 6. The center point of each of the time windows relative to the reference point of the L1 trigger signal may be at the anticipated peak time of the corresponding anticipated phase relationship. In this example, the time center point of each of the time windows relative to the falling edge of the L1 trigger signal may be:

$$t = \left(\frac{\text{Phase_Window}}{360} - 0.25\right)\left(\frac{1}{f}\right),$$

where Phase_Window is the phase relationship corresponding to the particular time window, and f is the frequency of the power line.

Using the equation above, the 120° (2π/3 radians), 180° (π radians), and 240° (4π/3 radians) phase windows may be centered at 1.39, 4.17, and 6.94 ms, respectively, from the falling edge of the L1 trigger signal for a 60 Hz power source. In other words, $t_6$-$t_1$ may be 1.39 ms, $t_8$-$t_1$ may be 4.17 ms, and $t_{10}$-$t_1$ may be 6.94 ms. For a 50 Hz power source the three time windows may be centered at 1.67 ms, 5 ms, and 8.33 ms, for the 120° (2π/3 radians), 180° (π radians), and 240° (π radians) time windows, respectively. Since the controller can determine the frequency (50 or 60 Hz) at the zero-cross circuit 104, the center points of each of the windows may either be fixed assuming the incoming signal frequency or determined based on the measured frequency at the zero-cross circuit 104.

The width of the time windows may be predetermined to be a fixed temporal width based on the anticipated conditions or determined based on the frequency of the incoming line voltage. For example, the predetermined temporal width may be 2.78 ms, such that the 120° (2π/3 radians) time window extends from 0 to 2.78 ms, and the 180° (π radians) window extends from 2.78 ms to 5.56 ms, and the 240° (4π/3 radians) window extends from 5.56 ms to 8.34 ms after the falling edge of the L1 trigger signal at $t_1$, for a 60 Hz power source. In such a case, the time windows are temporally abutting each other. Alternatively, there may be some temporal spacing between the three time windows. If a determination of the L2 peak is not made after the first falling edge of the L1 trigger at $t_1$, then a determination may be made after the second falling edge of the L2 trigger at $t_3$, with time windows (not shown) centered at $t_{12}$, $t_{13}$, and $t_{14}$, corresponding to the 120° (2π/3 radians), 180° (π radians), and 240° (4π/3 radians) time windows, respectively. Repeated readings over multiple line voltage periods may be used to gain confidence in the determined phase relationship.

When the peak in the L2 voltage is being detected by the voltage detection circuit 150 at the heater relay return node 140, the heater relay 152 may be open. By doing so, the L1 signal may not interfere with the voltage detection circuit 150, while the L2 voltage is detected. The voltage detection circuit 150 may include an analog-to-digital converter (ADC) that provides time series voltage levels of L2 to N to the controller 80. The controller 80 in turn may take the time series voltage levels of L2 to N and do a point-to-point difference of the data and look for a near-zero difference in the time series of voltage levels to identify the L2 peak voltage and corresponding peak time. Alternatively, the controller 80 may perform a point-to-point difference of the time series of voltage levels and identify the peak value and the peak time by identifying when the point-to-point difference transitions from a positive number to a negative number. As an alternative, analog peak detection circuitry may be used to provide the controller 80 with the peak voltage timing.

Once the phase between L1 to L2 is known the peak voltage can also be determined. If the phase relationship between L1 and L2 is 180° (π radians), then the L1 to L2 voltage may be:

$$L1 \text{ to } L2=(L1 \text{ to } N)+(L2 \text{ to } N)$$

If the (L1 to N) and (L2 to N) voltages were each determined to be 120 V, then the RMS voltage for an L1 to L2 phase relationship of 180° (π radians) may be 240 V. On the other hand, if the phase relationship between L1 and L2 is either 120° (2π/3 radians) or 240° (4π/3 radians), then the L1 to L2 voltage may be:

$$L1 \text{ to } L2=0.866*((L1 \text{ to } N)+(L2 \text{ to } N))$$

If the (L1 to N) and (L2 to N) voltages were determined to be 120 V, then the RMS voltage for an L1 to L2 phase relationship of 120° (2π/3 radians) or 240° (4π/3 radians) may be 208 V.

Figure 4:
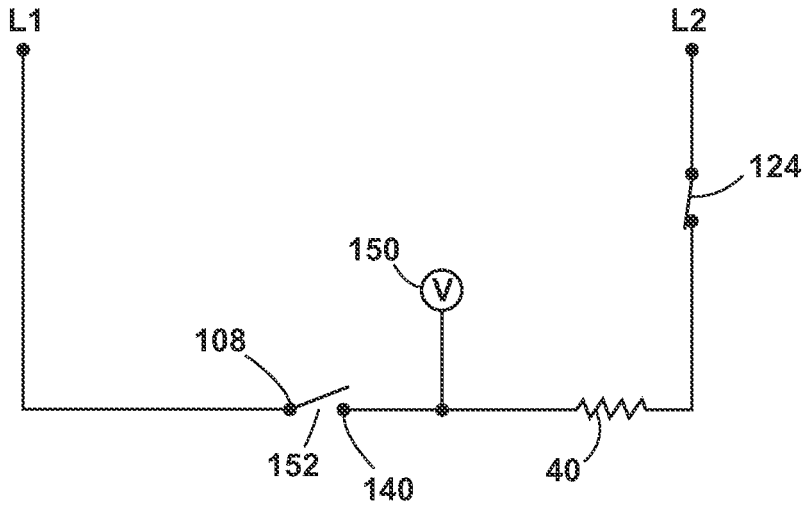
FIG. 4 is an equivalent circuit representation of a portion of the electrical wiring diagram of FIG. 3 when a heater relay is open.
Figure 5:
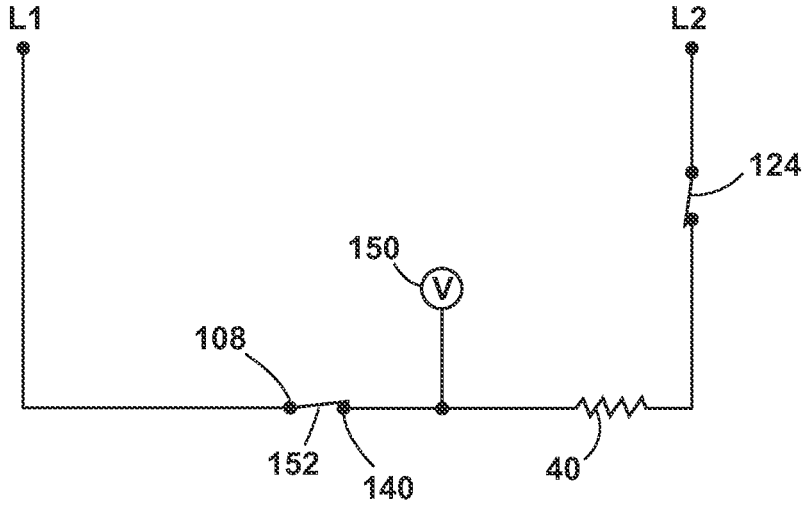
FIG. 5 is an equivalent circuit representation of a portion of the electrical wiring diagram of FIG. 3 when heater relay is closed.
Figure 8:
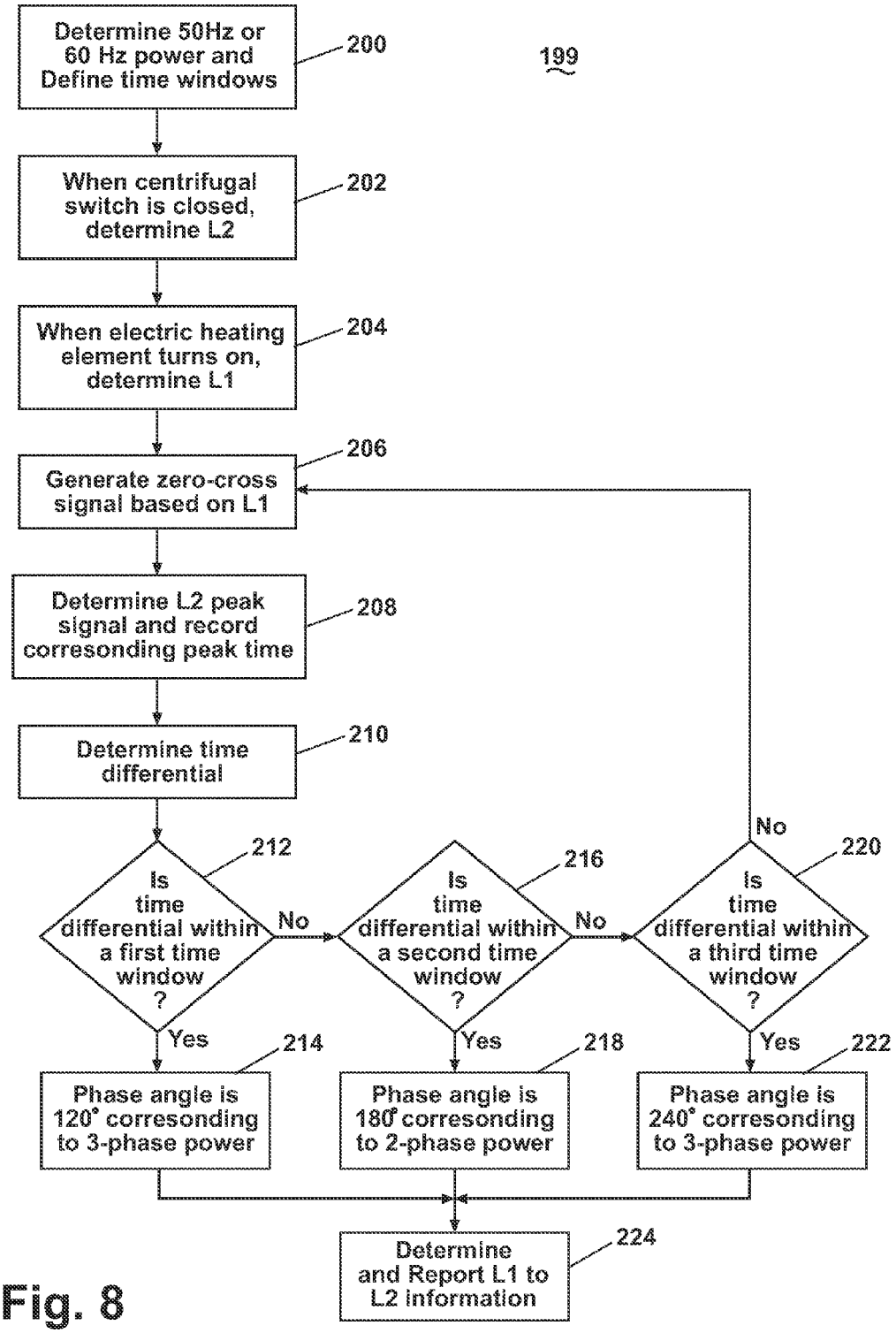
FIG. 8 is a flow chart summarizing the method for determining the L1 to L2 line voltage.

FIG. 8 is a flow chart that summarizes the method of determining the phase compensated L1 to L2 voltage 199 of the clothes dryer 10. First, it is determined whether the source of power is at 50 Hz or 60 Hz to define the time windows at 200. The frequency of the power source can be determined by various methods, including user input, assumptions based on the market the appliance is sold or designed for, or by measuring the period of a cycle using the voltage detection circuitry 150 at the heater relay return node 140, or using the trigger signal generated at zero-cross circuit 104. Once the source power frequency is determined, the location and width of the time windows can be determined by the methods disclosed in conjunction with FIG. 7. Next, when the heater switch 124 of the centrifugal switch 120 closes, the L2 to N voltage is determined at 202. At this point the equivalent electrical circuit along the electrical heating element 40 path is depicted by FIG. 4, where L2 voltage is present at the heater relay return node 140 and the L2 to N voltage is determined by the voltage detection circuit 150 at the heater relay return node 140. After L2 to N is determined, L1 to N is determined at 204, once the electrical heating element 40 turns on as a result of the heater relay 152 being closed to electrically connect the heater relay node 108 to the heater relay return node 140. At this point the equivalent electrical circuit along the electric heating element 40 path is depicted by FIG. 5, where L1 voltage is present at the heater relay return node 140 and the L1 to N voltage is determined by the voltage detection circuit 150 at the heater relay return node 140. Next, the zero-crossing timing signal is generated at the L1 input node at 206, based on the L1 signal, where the zero-crossing timing signal is a square wave with the same frequency as L1 and is positive when L1 is positive and is negative when L1 is negative. The L2 peak signal is next determined and the corresponding peak time is recorded at 208, using the methods disclosed in conjunction with FIG. 7. A time differential is determined next at 210, by taking the difference in the peak from a point on the zero-crossing timing signal, such as the rising or falling edge of the zero-crossing timing signal. It is then determined if the peak of the L2 signal lies within one of three time windows by determining if the time differential falls within the time window relative to the falling edge of the zero-crossing timing signal at 212, 216, and 220. Each of the time windows correspond to a L1 to L2 phase relationship of 120° (2π/3 radians), 180° (π radians), and 240° (4π/3 radians). If the peak lies in the first time window at 212, then the phase angle is determined to be 120° (2π/3 radians) corresponding to three-phase power supply at 214. If the peak lies in the second time window at 216, then the phase angle is determined to be 180° (π radians) corresponding to two-phase power supply at 218. If the peak lies in the third time window at 220, then the phase angle is determined to be 240° (4π/3 radians) corresponding to three-phase power supply at 222. If the peak location within one of the three time windows was not correctly determined, then the method loops back to 206, to continue to generate the zero-crossing timing signal to identify the phase relationship at the next or subsequent periods of the zero-crossing timing signal. Once the phase relationship, voltage levels and the type of poly-phase power is identified, the L1 to L2 information may be reported at 224. The reporting may be on a user interface (not shown) of the clothes dryer 10, such as on a control panel or other service, test or user device such as a phone, computer, test terminal, etc.

Alternatively, the L1 to L2 information may be used by the controller 80 to alter the control of the clothes dryer, predict cycle drying times, or predict time to end of drying cycle. For example, if it is known that the electric heating element 40 is receiving less than the expected level of power, then the controller 80 may compensate for this by energizing the electric heating element 40 for longer periods of time compared to what it would do otherwise.

The sequence of steps depicted is for illustrative purposes only, and is not meant to limit the method 199 in any way as it is understood that the steps may proceed in a different logical or sequential order and different, additional, overlapping, or intervening steps may be included without detracting from the invention.

There are many uses for identifying L1 to L2 voltage. Among these are to identify reasons for the clothes dryer not performing to expectations, identify if the house or laundromat is wired incorrectly, provide better control of the components of the dryer including the heater and the airflow system, and predict more accurate total cycle times and time remaining to the end of cycle. If the power supply to the clothes dryer is wired incorrectly, or if less than expected power is delivered to the clothes dryer, dryer cycle times may be longer than if the power supply was wired correctly and the power levels were to specification. This may have an impact on consumer satisfaction of the clothes dryer, if the consumer believes that the clothes dryer is not performing to specification. It can also have an impact on revenue at a laundromat, where throughput of customers may be improved if a dryer cycle times can be reduced.

The method disclosed herein has the advantage of identifying a phase compensated L1 to L2 voltage, with only a single voltage detection circuit. This is performed by first determining the L2 to N voltage at a voltage detection node. Next L1 to N is determined at the same voltage detection node. After, detecting both L1 to N and L2 to N voltage, the phase between L1 and L2 is still required to know the L1 to L2 voltage. The phase may be determined by generating a zero-crossing trigger signal corresponding to L1 at one node of the controller and then monitoring the peak voltage of L2 relative to a point on the zero-crossing trigger signal from the voltage detection node. By determining the time of the peak of the L2 signal relative to a zero-crossing event of the zero-crossing timing signal, and determining if that timing signal falls within one of three time windows corresponding to the same zero-crossing event, the phase between L1 and L2 can be ascertained. This method may not require any additional hardware beyond hardware that is typically found on clothes dryers and therefore may be a low cost method of providing L1 to L2 voltage information.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of determining a phase relationship between AC mains (L1 and L2) supplying electricity to an electric motor and electric heating element in a clothes dryer comprising a drying chamber, rotated by the electric motor, an air system supplying and exhausting air from the treating chamber, with the supply air heated by the electric heating element, and a controller coupled to and controlling the operation of the electric motor and electric heating element to implement a cycle of operation, the method comprising:

generating a zero-crossing timing signal from zero crossings of the L1 signal received by the controller;

determining a peak time corresponding to a peak in the amplitude of the L2 signal applied to the electric heating element;

determining a time differential between the peak time and a zero crossing from the zero-crossing timing signal; and determining the phase relationship by matching the time differential to at least one time window indicative of an anticipated phase relationship.

2. The method of claim 1 wherein the anticipated phase relationship is at least one of 120 degrees, 180 degrees, and 240 degrees.

3. The method of claim 1 wherein the temporal width of the at least one time window depends on the frequency of the electricity from the AC mains.

4. The method of claim 1 wherein the location of the at least one time window depends on the frequency of the electricity from the AC mains.

5. The method of claim 1 wherein the at least one time window comprises multiple time windows, with each time window corresponding to a different anticipated phase relationship.

6. The method of claim 5 wherein the multiple time windows comprise at least three time windows corresponding to 120 degrees, 180 degrees, and 240 degrees.

7. The method of claim 3 wherein each of the multiple time windows has a predetermined temporal width.

8. The method of claim 7 wherein the multiple time windows are temporally abutting.

9. The method of claim 6 wherein the predetermined temporal width is the same for each of the multiple time windows.

10. The method of claim 5 wherein each of the multiple time windows are centered on a corresponding anticipated time differential.

11. The method of claim 10 wherein the anticipated time differential for each of the multiple time windows comprises a time differential after a falling edge of the zero-crossing timing signal equal to the anticipated phase relationship in degrees divided by 360 minus one-fourth, all divided by the frequency of the electricity supply from the AC mains ((anticipated phase relationship/360−0.25)/(frequency of electricity supply from the AC mains)).

12. The method of claim 1 wherein determining the phase relationship further consists of comparing more than one time differential to at least one time window indicative of an anticipated phase relationship.

13. A method of determining a voltage across an electric heating element in a clothes dryer having a rotatable drying chamber, an electric motor rotating the drying chamber, an air system supplying air to and exhausting air from the drying chamber, with the supply air heated by the electric heating element, AC mains (L1, L2 and N) supplying electricity to the electric heating element and the electric motor, and a controller coupled to and controlling the operation of the electric motor and electric heating element to implement a cycle of operation, the method comprising:

sequentially determining L1 to N voltage and L2 to N voltage applied to the electric heating element;

generating a zero-crossing timing signal from zero-crossings of the L1 signal received by the controller;

determining a peak time corresponding to a peak in the amplitude of the L2 signal applied to the electric heating element;

determining a time differential between the peak time and a zero crossing from the zero-crossing signal;

determining a phase relationship between L1 and L2 by matching the time differential to at least one time window indicative of an anticipated phase relationship; and determining L1 to L2 voltage based on the L1 to N voltage, L2 to N voltage, and the phase relationship.

14. The method of claim 13 wherein the anticipated phase relationship is at least one of 120 degrees, 180 degrees, and 240 degrees.

15. The method of claim 13 wherein the temporal width of the at least one time window depends on the frequency of the electricity from the AC mains.

16. The method of claim 15 wherein the location of the at least one time window depends on the frequency of the electricity from the AC mains.

17. The method of claim 13 wherein the at least one time window comprises multiple time windows, with each time window corresponding to a different anticipated phase relationship.

18. The method of claim 17 wherein the multiple time windows comprise at least three time windows corresponding to 120 degrees, 180 degrees, and 240 degrees.

19. The method of claim 16 wherein the each of the multiple time windows has a predetermined temporal width.

20. The method of claim 19 wherein the multiple time windows are temporally abutting.

21. The method of claim 18 wherein the predetermined temporal width is the same for each of the multiple time windows.

22. The method of claim 17 wherein each of the multiple time windows are centered on a corresponding anticipated time differential.

23. The method of claim 22 wherein the anticipated time differential for each of the multiple time windows comprises a time differential after a falling edge of the zero-crossing timing signal equal to the anticipated phase relationship in degrees divided by 360 minus one-fourth, all divided by the frequency of the electricity supply from the AC mains ((anticipated phase relationship/360−0.25)/(frequency of electricity supply from the AC mains)).

* * * * *